US005385245A

United States Patent [19]

Waters

[11] Patent Number: 5,385,245

[45] Date of Patent: Jan. 31, 1995

[54] BELT RACK

[76] Inventor: Darrell J. Waters, 9955 S. Cottoncreek Dr., Highlands Ranch, Colo. 80126

[21] Appl. No.: 111,216

[22] Filed: Aug. 24, 1993

[51] Int. Cl.[6] ..... A47F 7/00

[52] U.S. Cl. ..... 211/13; 211/113

[58] Field of Search ..... 211/13, 60.1, 87, 113, 211/118; 248/126

[56] References Cited

U.S. PATENT DOCUMENTS 1,515,539 11/1924 Bank ..... 211/134
3,741,402 6/1973 Russell ..... 248/126 X
4,874,100 10/1989 Smagula ..... 211/13 X
4,966,287 10/1990 Snyder ..... 211/13
5,137,149 8/1992 Polacek ..... 211/113 X

*Primary Examiner*—Alvin C. Chin-Shue
*Assistant Examiner*—Sarah L. Purol
*Attorney, Agent, or Firm*—Kyle W. Rost

[57] ABSTRACT

A rack for storing and displaying apparel belts provides an elongated slot bounded by parallel edges for receiving a coiled belt, which is retained between the edges by friction from the compression of the expansive coil. The rack is provided with mounting mechanisms that permit combination of multiple racks, mounting of the rack to a vertical or horizontal surface, or suspension from a closet rod.

15 Claims, 4 Drawing Sheets

BELT RACK

TECHNICAL FIELD

The invention generally relates to a special receptacle or package for apparel, for an annular article, or for a roll or reel, especially to plural rolls and axially aligned rolls. The invention also generally relates to supports and racks, especially to those for a special article or stacked articles. Similarly, the invention generally relates to supports or racks that are specially mounted or attached, such as to a wall, with article-gripping means, or the support rack may be of the suspended type.

BACKGROUND ART

Individual articles in stores often are held in display racks that firmly clamp and retain each article but allow removal. For example, U.S. Pat. No. 4,182,455 to Zurawin discloses a holder for beverage cans, in which the holder defines a series of clamping arcs. Each beverage can is clamped by friction in an arc of greater than 180°. Another rack or holder is shown in U.S. Pat. No. 3,284,025 to Fridolph, in which the holder is axially opened to insert a spool of thread. Cylindrical holders for a paper roll are shown in U.S. Pat. No. 1,827,000 to Duffin. Spools of thread are carded in a simple magazine in U.S. Pat. No. 3,018,067 to Vandervoort. A cylinder for holding several belts in shown in U.S. Pat. No. 4,802,577 to O'Leary.

As shown by at least some of these examples of prior art, frictional holders long have been used for reliably holding a plurality of hard surfaced articles having regular, known size for commercial display. Yet often times in a home environment it is desired to hold and releasably retain a plurality of articles that are not of uniform size or hard surface, for which such commercial racks are not well suited. Especially in the case of apparel belts, storage and display in home closets is ill-achieved by commercial display racks. Often belts are stored on hooks or large rings, but these do not offer easy access to each belt.

Thus, it would be desirable to create a belt rack suited for home use, which allows a belt of non-predetermined size to be received and held. Similarly, it would be desirable that such a belt rack readily display its entire contents. Further, the rack should allow any of the belts it may contain to be removed directly, without requiring the other belts in the rack to be shuffled.

To achieve the foregoing and other objects and in accordance with the purpose of the present invention, as embodied and broadly described herein, the belt rack of this invention may comprise the following.

DISCLOSURE OF INVENTION

Against the described background, it is therefore a general object of the invention to provide an improved belt rack that permits the direct insertion and removal of substantially any apparel belt.

Another object is to provide a belt rack that is capable of accommodating belts of non-predetermined size over a considerable range of sizes.

A further object is to provide a belt rack that is expandable in capacity.

Still another object is to provide a belt rack that is adapted to a plurality or display environments such as free standing, wall mounting, shelf mounting, and hanging from a closet rod.

Additional objects, advantages and novel features of the invention shall be set forth in part in the description that follows, and in part will become apparent to those skilled in the art upon examination of the following or may be learned by the practice of the invention. The object and the advantages of the invention may be realized and attained by means of the instrumentalities and in combinations particularly pointed out in the appended claims.

According to the invention, a rack for storing and displaying apparel belts employs a generally vertically disposed carrier frame having opposite faces and perimetrically bounded by an outside edge along its top, bottom, and opposite sides and defines at least one belt-receiving opening through the frame. Another part of the rack is a frame support mechanism that includes a generally hook-shaped portion and is connected to the carrier frame for supporting the carrier frame with respect to an external surface, in a preselected one of a plurality of relative orientations. In a first of such orientations the carrier frame is positioned with the hook-shaped portion near the top of the frame, suspending the carrier frame by engaging an external surface. In a second of such orientations the carrier frame is positioned with the hook-shaped portion offset from a face of the frame, supporting the frame by contacting an external surface either below the bottom edge or the carrier frame or offset from a face of the carrier frame.

The accompanying drawings, which are incorporated in and form a part of the specification illustrate preferred embodiments of the present invention, and together with the description, serve to explain the principles of the invention. In the drawings:

BEST MODE FOR CARRYING OUT THE INVENTION

The belt rack of this invention provides a carrier frame that is capable of receiving one or more apparel belts placed in a rolled or coiled configuration. Each belt is received directly into the rack and, likewise, can be removed directly from the rack, all without requiting any other belt in the rack to be disturbed. The carder frame of the belt rack is capable of being mounted or carried in a variety of positions and orientations, such that the rack can be mounted on a horizontal or vertical surface or carried from a closet rod. Further, the frame can be combined with like frames in a plurality of configurations to build a rack of increased capacity.

Figure 1:
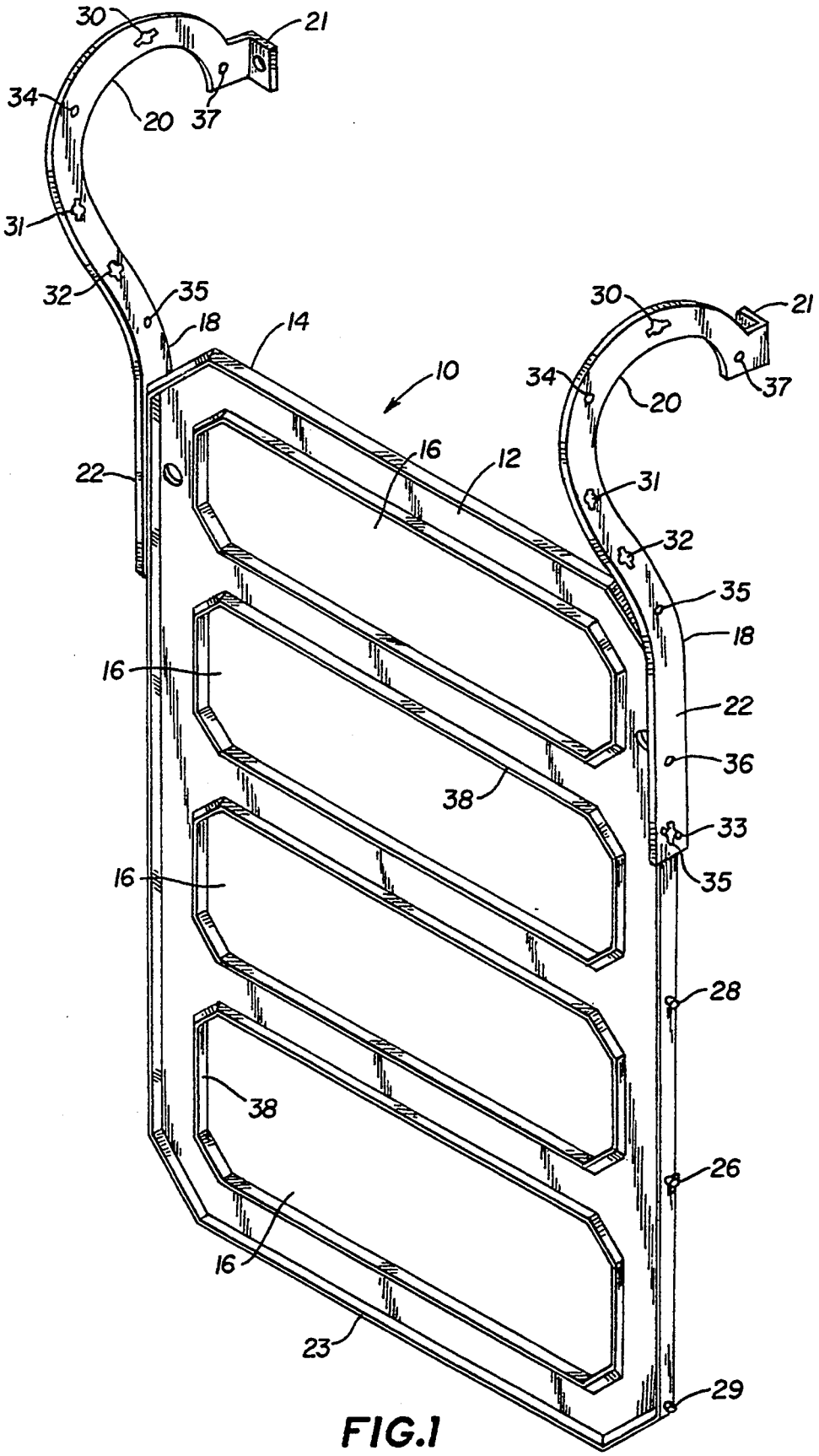
FIG. 1 is an isometric view of the belt rack, shown in an orientation for mounting on an overhead closet rod.

With reference to the embodiment of FIG. 1, a rack 10 for storing and displaying apparel belts is shown in its basic configuration. A generally vertically disposed carrier frame 12 is defined by a sheet of planar material having front and rear, opposite faces. The carder frame 12 defined by an outside edge 14 that bounds its perimeter along its top, bottom, and opposite sides. The frame defines at least one belt-receiving opening 16 formed through the frame and is preferred to define two or more such openings, which may be of different sizes in order to accommodate a variety of belt sizes or lengths.

Figure 2:
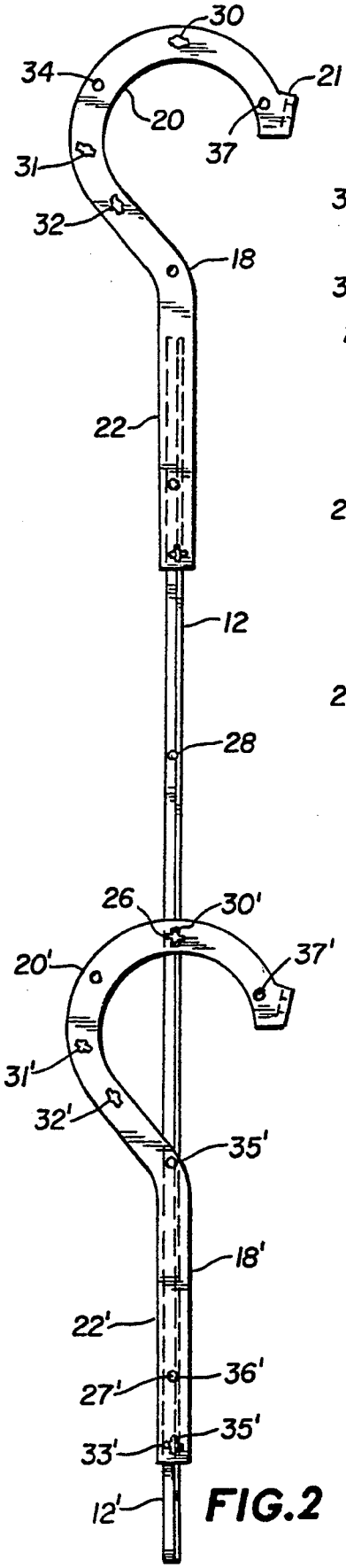
FIG. 2 is a side elevational view thereof, shown in the same orientation but with two racks in tandem.

The carrier frame is supported in any of several preselected orientations by a frame support means 18, which is one or more, and preferably two, elongated members having a generally hook-shaped end portion, such as head 20, having an opening along a front edge thereof, a closed top edge, a closed rear edge, and an elongated shank joined to the head at the rear edge and extending oppositely from the top edge. This frame support means 18 is connected to the carrier frame for the purpose of supporting the carrier frame with respect to an external surface, such as an overhead closet rod, a rear mounting wall, an underlying shelf surface or a dresser top. The supporting surface may be selected by the user, and, accordingly, the frame support means is attached the frame according to the user's selection of how the belt rack is to be positioned. Thus, the frame support means may be attached to the frame is one preselected relative orientation in which the carrier frame is positioned with the hook-shaped portion near the top of the frame as shown in FIGS. 1 and 2. When the hook-shaped head is substantially above the top of the outside edge of the frame, it may suspend the frame by engaging an external surface above the top edge, such as by engaging an overhead closet rod.

Alternatively, as shown in FIG. 2, a lower, tandem carder frame 12' may be attached in vertical tandem to upper frame 12, with the top edge of the tandem frame 12' abutting the bottom edge of the carrier frame 12. An attaching means connects the upper and lower frames. For example, the lower frame 12' may carry an elongated strap, clip, fastener, or, alternatively, as shown in FIG. 2, another frame support means 18' with hook shaped head 20' substantially identical in configuration to the frame support means 18 of the upper frame. Therefore, in FIG. 2 equivalent parts of the lower frame are given the corresponding numbers, with an added prime symbol. A pair of hook shaped heads 20' on opposite side edges of the lower frame engage a suitable mating attachment means carried by the upper frame.

Figure 3:
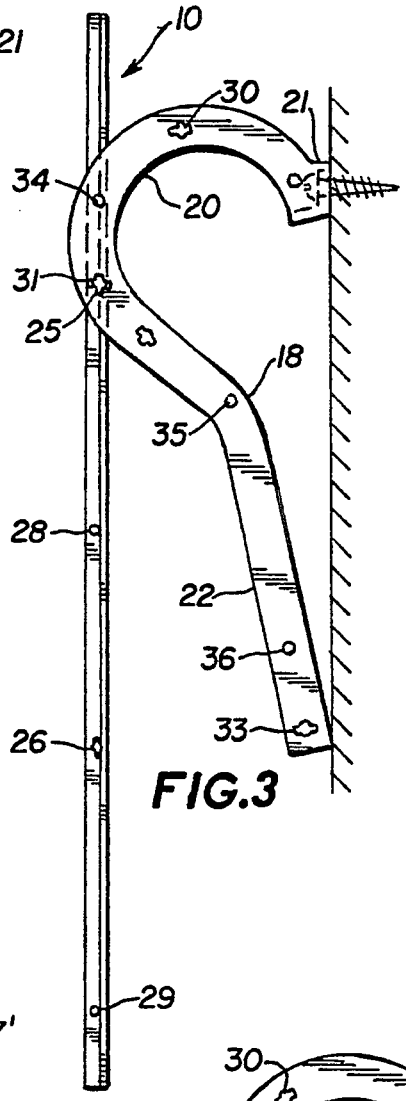
FIG. 3 is a side elevational view thereof, shown in an orientation for wall mounting.
Figure 4:
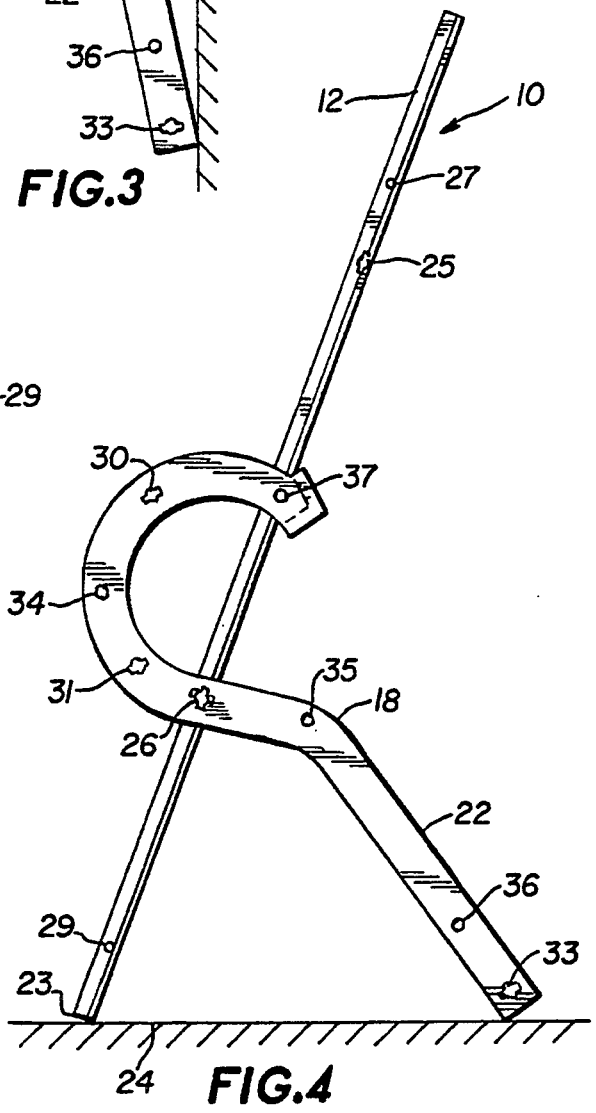
FIG. 4 is a side elevational view thereof, shown in an orientation for support on an underlying surface, such as a shelf or dresser top.

In a second orientation of the frame support means, as shown in FIGS. 3 or 4, the carrier frame is positioned with a pan of the frame support means, for example shank 22, offset from a face of the frame, supporting the frame by contacting an external surface either below the bottom edge or the carrier frame or offset from a face of the carrier frame. FIG. 3 shows the frame support means offset to the rear of the frame, such that a wall-mounting, slotted screw spade 21 on the tip of the head 20 can be mounted to a wail by a screw or nail. The elongated frame support means also includes a shank member 22. The hook-shaped head 20 is located at a longitudinal end of the shank, and the shank is offset from the frame in FIG. 3 by about the same distance as the spade 21 at the tip of the hook-shaped head portion 20. Thus, the shank 22 and the spade 21 are positioned against a vertical wail for supporting the frame in the embodiment of FIG. 3.

In FIG. 4, the frame support means 18 is offset from the face of the frame in another angled relative orientation, rotated approximately sixty to ninety degrees from the orientation of FIG. 1. In this embodiment the rack is suited to be supported on an underlying shelf. The bottom edge 23 of the frame rests on shelf 24, and the shank 22 provides a second support spaced from edge 23.

The multiple orientations of the frame support means 18 with respect to the carrier frame are made possible by an engaging means for selectively and releasably interconnecting the carrier frame 12 and the frame support means 18 in a plurality of relative orientations. In the embodiments of FIGS. 1–4, the engaging means may be comprised of a clip, plurality of clips, key and keyway, pin and socket, or other engagable or mating structures, appropriately arranged between the carrier frame 12 and support means 18. The preferred embodiment, illustrated in the drawings, employs a combination of mating structures. Specifically, a plurality of keys and keyways provide a selectively engagable, locking connection between the frame and support means; while a plurality of pins and sockets provide a second, supplemental, selectively engagable, stabilizing connection, such that the support means and frame are united at least at two spaced apart attachment points.

The frame 12 and frame support means 18 carry between them first and second mating members, which combine to form a complete mating structure. A portion of each mating structure, such as a lug, boss, pin or key extends transversely from the side of the carrier frame. The support means 18 carries or defines therein the second portion of each mating structure, such as a hook, clip, socket, or keyway. The frame as shown in FIGS. 1–4 carries, for example, two keys and three pins extending laterally from each side edge thereof. An upper key 25 is positioned about one-fourth of the distance from the top of the frame, while a lower key 26 is positioned about one-third of the distance from the bottom of the frame. An upper pin 27 is positioned about one-sixth of the distance from the top of the frame; a central pin 28 is near the middle of the frame height; and a lower pin 29 is positioned about one-twelfth of the distance from the bottom of the frame. The support means defines mating keyways, including a first keyway 30 on hook 20 and in axial alignment with shank 22; a second keyway 31 on the back edge of hook 20 opposite from the free end of the hook; a third keyway 32 between keyway 31 and the shank 22; and a fourth keyway 33 near the free end of the shank. The support means also defines pin sockets, including a first socket 34 between keyways 30 and 31; a second pin socket 35 near the intersection of the shank and hook, in axial alignment with the shank and keyway 30; a third pin socket 36 on the shank, spaced upwardly from keyway 33, and a fourth pin socket 37 near the tip of the hook.

FIG. 2 illustrates one means attaching the carrier frame 12 to the tandem frame 12'. In addition, the other drawings show the way in which the keys and keyways and pins and pin sockets engage for each predetermined position of the support means on the carrier frame. In each position, one key fits through a keyway, after which the support means is rotated with respect to the frame, locking the key in the keyway. When the support means is rotated to the illustrated position, a pin and pin socket are in position to be engaged. The flexibility of the support means allows the support means to be deflected sufficiently to pass over the pin, after which the resilience of the support means causes the pin socket to engage the aligned pin. As a specific example, in FIG. 2 on the upper frame 12, key 26 engages keyway 30', and pin 29 engages pin socket 35'. On the lower frame 12', keyway 33' engages key 25', and pin 27' engages pin socket 36'. Thus, two attachment points connect each frame to each frame support means, so that the support means and frame are in a non-pivoting relationship. In addition, the bottom edge of frame 12 is in abutting contact with the upper end of frame 12'.

The belt-receiving openings 16 also may be bounded by a perimetric flange 38, This flange adds rigidity and strength of the frame at the openings and provides a stabilizing contact surface for the coiled belts received in the openings.

Figure 5:
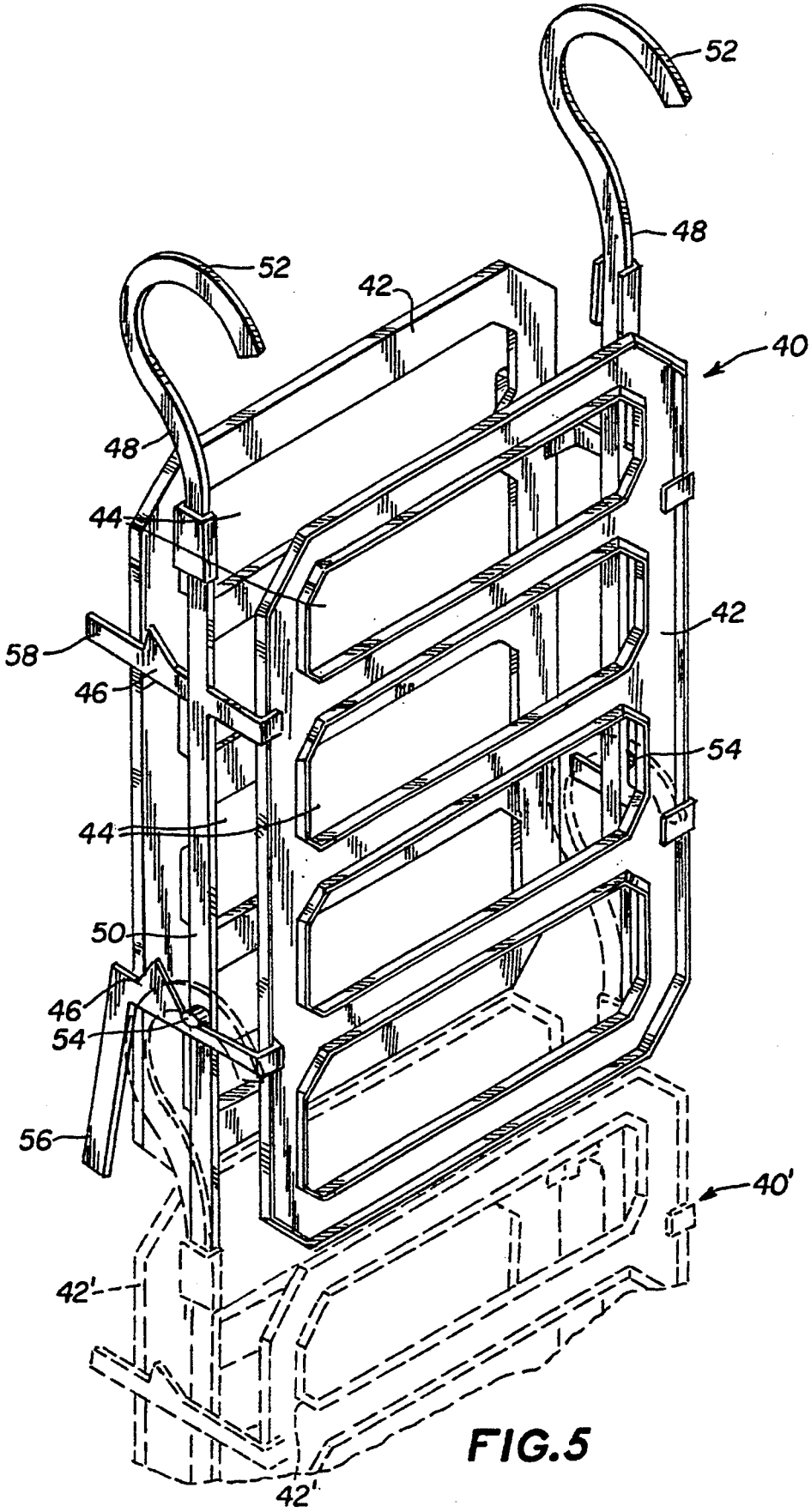
FIG. 5 is an isometric view of a second embodiment thereof, shown in an orientation for mounting from an overhead surface, and showing in phantom a second rack attached in tandem.

With reference to the further embodiment of FIG. 5, the belt rack 40 employs first and second generally vertical, planar, carrier frames 42 similar the frames 12 described above. The two frames are approximately parallel and offset from each other at their faces. Each defines at least one belt-receiving opening 44, and these openings are approximately aligned with each other such that a belt rolled into an expansive coil is receivable through both aligned belt-receiving openings for frictional retention by compression of the expansive coil. The two frames provide greater stability and retention, although inserting or removing a belt is more difficult than in the prior embodiment.

The rack 40 employs at least one spacing member and preferably has four spacing members 46 divided into upper and lower spacing members on each side of the rack. These members 46 are disposed approximately horizontally between the two frames 42. The spacing members 46 are elongated, and have a front edge and a rear edge. They are connected to the first and second carrier frames and maintain the frames in spaced apart position, such that at least an opposite portion of each of the carrier frames is located between the front and rear edges of the spacing members 46. Thus, the center of gravity of the first and second carrier frames is located between the front and rear edges of the spacing members. A frame support means 48 similar to that described above is connected to the spacing member 46 for externally suspending the spacing member along a vertical axis passing intermediate its front and rear edges.

For example, the frame support means 48 may be formed of an elongated shank 50 having a hook-like head 52. As shown in FIG. 5, one such shank is on each side of the rack and is joined to the spacing members 46 between the two carrier frames, defining end frames. The hook-like heads 52 extend above the top edges of the carrier frames for suspending the rack from an overhead closet rod, maintained in the upper recess of the hook. The center of gravity of the rack is located between the carrier frames, approximately in the plane of the two shanks. Thus, the rack will hang straight when a closet rod is received in the hook-like head 52. Even when the rack carries one or more apparel belts placed in a rolled or coiled configuration, the center of gravity of these belts is likely to be between the carrier frames and will not substantially change the disposition of the rack.

As in the first embodiment, each belt is received directly into the rack and, likewise, can be removed directly from the rack, without requiring any other belt in the rack to be disturbed. The carrier frames of the belt rack are capable of being mounted or carried in a variety of other positions, such that the rack can be mounted on a horizontal or vertical surface, as well. Further, the frame can be combined with like frames in a plurality of configurations to build a rack of increased capacity.

In FIG. 5, a lower, second rack 40' is shown in tandem with the upper, first rack 40. This configuration results from the hook like heads of the lower rack 40' being hooked over laterally extending lugs 54 located on the shanks 50. The relative position of the lugs 54 maintains the upper and lower racks in close contact, with the upper edges of lower frames 42' being closely adjacent to the lower edges of upper frames 42.

The rack 40 can be supported from a shelf or like underlying surface. The frame support means includes legs 56 attached to lower spacing means 46 and angling downwardly and rearwardly from the rear end of the lower members 46. Legs 56 cooperate with the lower edges of the carrier frames 42 to provide a stable base for the rack against a shelf.

The rack 40 also can be mounted on a vertical wall. The frame support means further includes rearwardly extending legs 58 attached to the upper spacing means 46 and extending rearwardly. Legs 56 and 58 may be mounted to a wall and will maintain the carrier frames 42 at a spaced distance from the wall.

Figure 6:
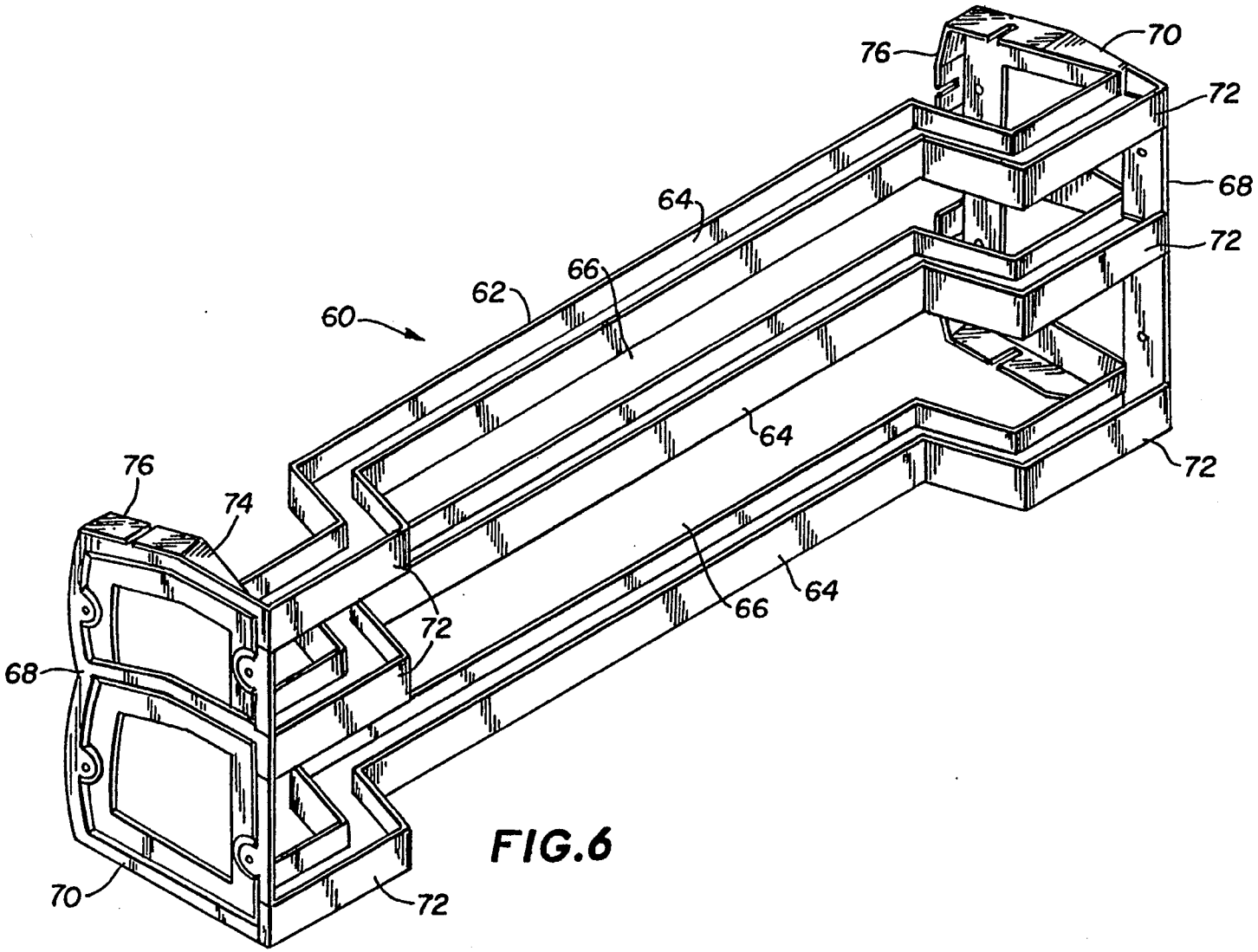
FIG. 6 is an isometric view of a third embodiment thereof.

A third embodiment of the invention is shown in FIG. 6, in which the belt rack 60 is formed by a generally vertically disposed carrier frame 62 formed plurality of elongated bars 64. Frame 62 has front and rear opposite faces and is perimetrically bounded by an outside edge along its top, bottom, and opposite sides. The carrier frame 62 defines at least one and preferably more belt-receiving openings between the bars 64.

A frame support means 68 is formed at each end of the frame 62 and may take the form of a closed end frame 70. The end portions of the bars 64 are offset to the front of the central portions of these bars. Each end frame 70, together with offset end portions 72 of the bars 64, define a generally hook-shaped portion 74 of the frame support means, with a recess for retaining the hook-shaped portion over a closet bin or the like. The recess is greatest on the inside face of the end frame, at a meeting of an end frame with frame bar end portions 72. These hook-shaped portions have an open edge facing the rear of the rack as shown in FIG. 6 and include portions of the hook offset toward both the front and rear of the frame 62. This frame support means is connected to the carrier frame for supporting the carrier frame against an external surface, in a preselected one of a plurality of relative orientations.

In a first orientation, the carrier frame is positioned on end, relative to the view of FIG. 6. The bars 64 are disposed in approximately vertical orientation, and one of the hook-shaped portions 74 is at the top of the rack. This top hook-shaped portion is capable of suspending the carrier frame by being hooked over an external object such as an overhead closet rod.

In a second orientation, the carrier frame 62 is positioned approximately as shown in FIG. 6, with the bars 64 being disposed in a common vertical plane but longitudinally oriented approximately horizontally. In this orientation, the offset portions of the frame support means 68 establish a sufficient base from the faces of the frame to support the rack stably against an underlying shelf or other surface below the bottom edge of the carrier frame.

The frame support means 68 includes a top, bottom, and rear flange surface 76 around the end frames 70 for mounting the rack on a vertical wall or combining racks. This flange surface may define mounting slots that receive a screw or nail. The rearward offset of the end frames is sufficient that the rear flange surface supports the bars 64 at a sufficient distance from the wall that there is adequate room to receive coiled belts between the bars. The top and bottom flange surfaces 76 permit racks to be stacked and bolted or clipped to each other.

In use of these racks, a coiled belt can be nested between the top and bottom edges of any of the belt-receiving openings. A central axis of the coil would lie approximately between the bottom and top edges of the opening, or in the embodiment of FIG. 5, between the two carrier frames. The belt is held in compression, created by the resiliency of the belt coil. The tendency of a resilient coil to bulge toward the edges of the opening is an aid to retention.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be regarded as falling within the scope of the invention as defined by the claims that follow.

I claim:

1. A rack for storing and displaying coiled apparel belts, comprising:

a generally vertically disposed carrier frame having opposite faces and perimetrically bounded by an outside edge along its top, bottom, and opposite sides, and defining at least one belt-receiving opening therethrough positioned, in use, with space on both sides of said opening for carrying a substantial portion of a coiled belt;

a frame support means, at least a part of which defines a generally hook-shaped portion, connected to said carrier frame for supporting the carrier frame, in use, with respect to an external surface, in a preselected one of a plurality of relative orientations, wherein, in at least a first relative orientation between the carrier frame and said frame support means, said hook-shaped portion is non-coplanar with the face of the frame and extends transversely to at least one side of the frame, supporting the frame by contacting, in use, an external surface either below the bottom edge or the carrier frame or offset from a face of the carrier frame.

2. The rack defined by claim 1, wherein:

in at least a second relative orientation between said carrier frame and said frame support means, the frame support means is non-coplanar with the face of the frame, with said hook-shaped portion near the top of the frame and suspending the carrier frame by engaging, in use, an external surface.

3. The rack defined by claim 2, further comprising:

an engaging means carried by said frame support means for selectively and releasably interconnecting said carrier frame and the frame support means in said plurality of relative orientations;

wherein, in said second relative orientation, said engaging means is attached to the carrier frame in a position carrying said hook-shaped portion substantially above the top of the outside edge of the carrier frame and suspending the carrier frame, in use, by engaging an external surface above the top of said outside edge.

4. The rack defined by claim 1, wherein:

said frame support means comprises an elongated member, and said generally hook-shaped portion is a longitudinal end portion of said elongated member; and further comprising:

an engaging means carried by the frame support means for selectively and releasably interconnecting said carrier frame and the frame support means in said plurality of relative orientations.

5. The rack defined by claim 4, wherein said carrier frame further comprises:

a flange disposed approximately normal to the plane of the carrier frame and bordering the carrier frame at its outside edge; and wherein said engaging means comprises a first mating member carried by said frame support means and a second mating member carried by the carrier frame at said flange and engageable with said first mating member, releasably attaching the frame support means to the frame at the flange.

6. The rack defined by claim 5, wherein said flange is a T-shaped flange.

7. The rack defined by claim 4, wherein:

said hook-shaped portion of said frame support means has an opening along a front edge thereof, a closed top edge, a closed rear edge, and an elongated shank joined to the hook-shaped portion at said rear edge and extending oppositely from said top edge thereof;

said engaging means is located on the hook-shaped portion for attaching the frame support means to said carrier frame in said first orientation at least at two attaching points; and said shank has a free end opposite the hook-shaped portion and disposed in a common plane with the bottom edge of the carrier frame, the free end of the shank and the bottom edge of the carrier frame together forming a supporting base for the career frame against, in use, an underlying surface.

8. The rack defined by claim 4 wherein:

said hook-shaped portion of said frame support means has an opening along a front edge thereof, a closed top edge, a closed rear edge, and an elongated shank joined to said hook-shaped portion at said rear edge and extending oppositely from said top edge thereof;

said engaging means is located on said shank for attaching the frame support means to said carrier frame in said second orientation at least at two attaching points; and said top edge of the hook-shaped portion is disposed above the top of the carrier frame.

9. The rack defined by claim 8, wherein:

said engaging means is located on a distal end of said shank and attaches the elongated member to the frame in said second orientation.

10. The rack defined by claim 2, further comprising:

a tandem frame having top, bottom and side edges, disposed approximately coplanar with said carrier frame, having its top edge approximately abutting the bottom edge of the carrier frame, and defining at least a second belt-receiving opening therethrough;

means attaching said tandem frame to said carrier frame.

11. The rack defined by claim 2, wherein:

said belt-receiving opening is bounded by a perimetric flange.

12. The rack defined by claim 1, wherein said carrier frame is a first carrier frame, and further comprising:

a second carrier frame offset from a face of the first carrier frame, having at least one belt-receiving opening therethrough and approximately aligned with the belt-receiving opening of the first carrier frame, such that, in use, a belt rolled into an expansive coil is receivable through said belt-receiving openings of the first and second carrier frames for frictional retention within said openings by compression of the expansive coil; and at least one spacing member having a front edge and a rear edge, connected to the first and second carrier frames and maintaining said frames in spaced apart position, having at least an opposite portion of each of the carrier frames located between the front mid mar edges of said spacing member such that the center of gravity of the first and second carrier flames is located between the front and rear edges of the spacing member; and wherein said frame support means is connected to the spacing member for externally suspending the spacing member along a vertical axis passing intermediate, the front and rear edges thereof.

13. The rack defined by claim 12, wherein said spacing member comprises a first end frame, and further comprising:

a second end frame spaced apart from the first end frame, wherein each end frame is attached to an opposite side edge of said first and second carrier frames;

the first carrier frame comprises a first pair of spaced apart bars attached at their respective opposite ends to the first and second end frames and defines a belt-receiving opening between said first pair of bars; and the second carrier frame comprises a second pair of spaced apart bars attached at their respective opposite ends to the first and second end frames and defines a belt-receiving opening between said second pair of bars.

14. The rack defined by claim 13, wherein said frame support means defines a recess in an inside face of at least one of said end frames for, in use, being received over a closet rod.

15. The rack defined by claim 14, wherein said frame support means defines said recess at a meeting of an end frame with at least one of said first and second pairs of bars.

* * * * *